US009295292B2

(12) United States Patent
Sachs

(10) Patent No.: US 9,295,292 B2
(45) Date of Patent: Mar. 29, 2016

(54) GARMENT WITH WINDOW AND DETACHABLE POCKET

(71) Applicant: Ronald James Sachs, Gibsonia, PA (US)

(72) Inventor: Ronald James Sachs, Gibsonia, PA (US)

(73) Assignee: Jacob Ash Holdings, Inc., McKees Rocks, PA (US)

( * ) Notice: Subject to any disclaimer, the term of this patent is extended or adjusted under 35 U.S.C. 154(b) by 71 days.

(21) Appl. No.: 14/255,004

(22) Filed: Apr. 17, 2014

(65) Prior Publication Data

US 2015/0296909 A1 Oct. 22, 2015

(51) Int. Cl.

| | |
|---|---|
| ***A41D 27/20*** | (2006.01) |
| ***A41B 1/08*** | (2006.01) |
| ***A41D 1/02*** | (2006.01) |
| ***A41D 1/04*** | (2006.01) |
| ***A41D 1/00*** | (2006.01) |

(52) U.S. Cl.

CPC ..... *A41D 27/205* (2013.01); *A41B 1/08* (2013.01); *A41D 1/002* (2013.01); *A41D 1/02* (2013.01); *A41D 1/04* (2013.01); *A41D 27/201* (2013.01)

(58) Field of Classification Search

CPC ..... A41D 1/002; A41D 27/205

See application file for complete search history.

(56) References Cited

U.S. PATENT DOCUMENTS

| | | | |
|---|---|---|---|
| D2,835 | S | 11/1867 | Seldis |
| D2,841 | S | 11/1867 | Seldis |
| D3,697 | S | 10/1869 | Kappelhoff |
| D3,946 | S | 3/1870 | Seldis |
| D4,019 | S | 5/1870 | Simonet |
| D4,254 | S | 7/1870 | Kappelhoff |
| D6,826 | S | 8/1873 | Gross |
| D7,536 | S | 7/1874 | Prindle |
| D7,537 | S | 7/1874 | Prindle |
| 255,420 | A | 3/1882 | Cunningham |
| 369,817 | A | 9/1887 | Salamon |
| D29,775 | S | 12/1898 | Judenfreind |
| D97,236 | S | 10/1935 | Lobel |
| D97,237 | S | 10/1935 | Lobel |
| D97,354 | S | 10/1935 | Lobel |
| D115,369 | S | 6/1939 | Block |
| D116,525 | S | 9/1939 | Taks |
| D123,010 | S | 10/1940 | Berger |
| D132,161 | S | 4/1942 | Baer |
| D132,162 | S | 4/1942 | Baer |
| D132,163 | S | 4/1942 | Baer |

(Continued)

FOREIGN PATENT DOCUMENTS

| | | | |
|---|---|---|---|
| DE | 20 2007 016 525 | U1 | 3/2008 |
| GB | 2440604 | A | 2/2008 |

(Continued)

OTHER PUBLICATIONS

Hardy K. J.; title: We Tried It; copyright 2009; The Detroit News; Detroit, Michigan, USA; (1 page).

(Continued)

*Primary Examiner* — Anna Kinsaul

(74) *Attorney, Agent, or Firm* — Metz Lewis Brodman Must O'Keefe LLC

(57) ABSTRACT

A garment for use with an electronic device is provided that has a front surface. A pocket is included that has a window. The pocket has an attached portion that is non-removably attached to the front surface. The pocket has a releasable portion that is releasably attachable to the front surface.

22 Claims, 6 Drawing Sheets

(56) References Cited

U.S. PATENT DOCUMENTS

| | | | | |
|---|---|---|---|---|
| D132,164 | S | 4/1942 | Baer | |
| D138,009 | S | 5/1944 | Stackhouse | |
| 2,557,280 | A | 6/1951 | Hahn | |
| 2,611,901 | A | 9/1952 | Neider | |
| 2,727,241 | A | 12/1955 | Smith | |
| 2,751,952 | A | 6/1956 | Mirus | |
| 2,986,743 | A | 6/1961 | Eilen | |
| 3,203,005 | A | 8/1965 | Burrows | |
| 3,491,373 | A | 1/1970 | Thomas | |
| 3,793,643 | A | 2/1974 | Kinoshita | |
| D254,216 | S | 2/1980 | Caputo | |
| 4,202,053 | A | 5/1980 | Bell | |
| D255,505 | S | 6/1980 | Karolak | |
| 4,221,954 | A | 9/1980 | Cohen | |
| 4,408,355 | A | 10/1983 | Brock | |
| 4,495,659 | A | 1/1985 | Madnick | |
| D300,984 | S | 5/1989 | Carter | |
| 4,876,724 | A | 10/1989 | Suzuki | |
| 4,893,357 | A | 1/1990 | Evans | |
| 4,949,887 | A | 8/1990 | Holmes | |
| 5,139,187 | A | 8/1992 | Fowler | |
| 5,173,968 | A | 12/1992 | Fox | |
| 5,241,706 | A | 9/1993 | Netz | |
| 5,269,023 | A | 12/1993 | Ross | |
| 5,461,728 | A | 10/1995 | Staszak | |
| D364,724 | S | 12/1995 | Bates | |
| 5,499,401 | A | 3/1996 | Heinmiller | |
| D371,892 | S | 7/1996 | Geer | |
| D373,235 | S | 9/1996 | Caponelli | |
| 5,678,249 | A | 10/1997 | Smith | |
| 5,682,610 | A | 11/1997 | Warner | |
| 5,699,632 | A | 12/1997 | Stout | |
| 5,787,505 | A | 8/1998 | Plwko | |
| 5,794,263 | A | 8/1998 | Carman | |
| 5,845,337 | A | 12/1998 | Smith | |
| 5,884,338 | A * | 3/1999 | Golde | A41D 27/20 2/247 |
| 5,924,135 | A | 7/1999 | Worth | |
| 5,953,757 | A | 9/1999 | Blanks | |
| 6,014,774 | A | 1/2000 | Davey | |
| D440,738 | S | 4/2001 | Cliche | |
| 6,397,395 | B1 | 6/2002 | DeHart | |
| D472,364 | S | 4/2003 | Riedler | |
| 6,665,878 | B1 | 12/2003 | Way | |
| 6,774,296 | B2 | 8/2004 | Aesch | |
| 6,826,782 | B2 | 12/2004 | Jordan | |
| 7,003,810 | B2 | 2/2006 | Goldkind | |
| 7,168,098 | B2 | 1/2007 | West | |
| 7,296,303 | B1 | 11/2007 | Sament | |
| 2002/0095712 | A1 | 7/2002 | Fayle | |
| 2004/0035742 | A1 | 2/2004 | Aesch | |
| 2007/0139875 | A1 | 6/2007 | Carstens | |
| 2007/0261703 | A1 | 11/2007 | Gheneva | |
| 2008/0196140 | A1 | 8/2008 | Mayerson | |
| 2008/0222780 | A1 | 9/2008 | Johnson | |
| 2010/0299800 | A1 | 12/2010 | Jackson | |
| 2012/0042428 | A1 | 2/2012 | Jarboe | |
| 2012/0151655 | A1 | 6/2012 | Jarboe | |

FOREIGN PATENT DOCUMENTS

| | | | |
|---|---|---|---|
| JP | 3316498 | B1 | 6/2002 |
| JP | 3343552 | A | 8/2002 |
| WO | WO 2005/096853 | | 10/2005 |

OTHER PUBLICATIONS

H&L Apparel; title: Stay Connected Stay Warm; website http://www.mediamuff.com/home; visited Mar. 2010; copyright Mar. 2010, Media Muff; (2 pages).

Alibaba.com; title: Media Muff; website http://www.alibaba.com; visited Mar. 2010; copyright Mar. 2010; Media Muff; (2 pages).

The Pitch Kansas City; title: $20 Media Muff-Stay Warm, Stay Connected; website http://www.pitch.com; visited Dec. 27, 2009; copyright Dec. 27, 2009; Media Muff; (1 page).

United States Patent and Trademark Office; Office Action from U.S. Appl. No. 13/285,075; mailed Mar. 26, 2014; United States Department of Commerce; Alexandria, Virginia, USA; pp. 1-16; (16 pages).

United States Patent and Trademark Office; Office Action from U.S. Appl. No. 13/285,075; mailed Aug. 30, 2012; United States Department of Commerce; Alexandria, Virginia, USA; pp. 1-15; (15 pages).

United States Patent and Trademark Office; Office Action from U.S. Appl. No. 12/353,239; mailed Jun. 5, 2012; United States Department of Commerce; Alexandria, Virginia, USA; pp. 1-19; (19 pages).

United States Patent and Trademark Office; Office Action from U.S. Appl. No. 12/353,239; mailed Dec. 7, 2011; United States Department of Commerce; Alexandria, Virginia, USA; pp. 1-19; (19 pages).

United States Patent and Trademark Office; Office Action from U.S. Appl. No. 12/353,239; mailed Sep. 1, 2011; United States Department of Commerce; Alexandria, Virginia, USA; pp. 1-17; (17 pages).

United States Patent and Trademark Office; Office Action from U.S. Appl. No. 12/353,239; mailed May 26, 2011; United States Department of Commerce; Alexandria, Virginia, USA; pp. 1-14; (14 pages).

United States Patent and Trademark Office; Office Action from U.S. Appl. No. 13/401,315; mailed Aug. 30, 2012; United States Department of Commerce; Alexandria, Virginia, USA; pp. 1-15; (15 pages).

Legendary Whitetails; title: Youth Textpac Realtree Xtra Camo Buck Hoodie; website http://www.deergear.com/product/Youth-Textpac-Realtree-Xtra-Camo-Buck-Hoodie/157484.uts; visited 2013; copyright 2013, Legendary Whitetails; (2 pages).

* cited by examiner

GARMENT WITH WINDOW AND DETACHABLE POCKET

FIELD OF THE INVENTION

The present invention relates generally to garments that have a window that allows an electronic device to be viewed and utilized while inside of the garment. More particularly, the present application involves a hoodie that has a windowed pocket detachable from the front surface of the hoodie for view of an electronic device within the pocket and for easier use of the garment into which the hands of the user may be positioned.

BACKGROUND

Hand-held or wrist/hand mounted electronic devices such as cell phones, personal digital assistants (PDA), electronic games, wearable electronic devices such as watches, pagers, calculators, puzzle solvers, miniature computers, combinations of the preceding, etc., have become prevalent in society, with their use becoming increasingly common and being adopted by users of increasingly younger ages. Such devices have found use in placing phone calls, sending text messages, playing games, browsing internet pages, purchasing goods and services, solving puzzles, and other sundry uses. Some garments are known to have been adapted for using such hand-held electronic devices and related devices. Further, some garments are known to have various pockets or other features so as to provide a particular utility to the user of the garment.

One known garment disclosed with reference to United States Patent Publication No. 2012/0151655 is a hoodie that has a pocket located on the front surface of the garment that has open ends into which both hands of the wearer can be received in order to keep the hands warm and dry during inclement weather. The entire contents of United States Patent Publication No. 2012/0151655 are incorporated herein in their entirety for all purposes. The outer surface of the pocket has a flap that can be opened up in order to reveal a window. The window allows one to view inside of the pocket. Although capable of allowing a wearer to see through the window to the inside of the pocket to use and view an electronic device within the pocket, the pocket is not adjustable and the window is not located in a convenient position for use by the wearer. If the user desires the position of the window be modified for comfort of use, the user will pull on the entire pocket. As the pocket is rigidly attached to the front surface, the front surface of the garment will be pulled, twisted, tugged out of place thus disrupting wear of the garment and causing discomfort to the user. Further, the need to manipulate a flap on the outer surface may be troubling to the wearer. Still further, the sight of a covering flap on the outside surface of the pocket may be undesired by the wearer. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS. in which.

Figure 1:
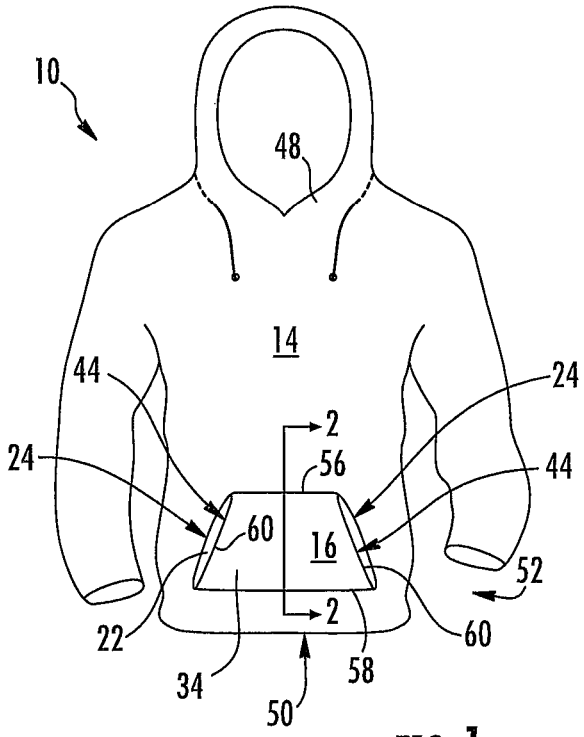
FIG. 1 is a front elevation view of a garment with a detachable pocket in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a garment 10 that includes a detachable pocket 16 for use in keeping the hands of a wearer 42 warm and dry during inclement weather. The pocket 16 has a window 40 through which the wearer 42 may view an electronic device 12 within the pocket 16. The wearer 42 may thus manipulate or view the electronic device 12 by viewing same through the window 40 while both the hands 64 and the electronic device 12 are located within the pocket 16. The pocket 16 has a detachable portion so that the pocket 16 can be moved to a position that is comfortable for the wearer 42 relative to the front surface 14 of the garment 10 when use of the electronic device 12 within the pocket 16 is desired. Although described as having utility during bad weather, the pocket 16 arrangement may also be utilized when the wearer 42 wants to use the electronic device 12 but does not wish others to see the electronic device 12 or the displayed content of the electronic device 12.

Figure 2:
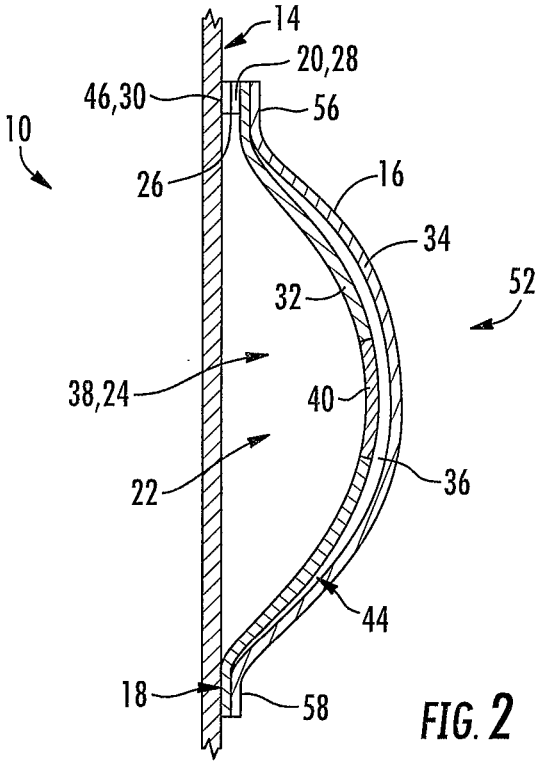
FIG. 2 is a cross-sectional view taken along line 2-2 of FIG. 1 with a portion of the garment not shown for clarity.

An exemplary embodiment of the garment 10 is illustrated with reference to FIGS. 1 and 2. The garment 10 is disclosed as being a hoodie 10, and the pocket 16 is located on the front surface 14 of the hoodie 10. However, it is to be understood that this is but one arrangement, and that the garment 10 need not be a hoodie 10 in other exemplary embodiments. The garment 10 may be a sweatshirt, a sweater, a jacket, a shirt, or any other item worn on the body of the wearer 42. Further, although shown as being located on the front surface 14, the pocket 16 may be located on the back surface, right side surface, left side surface, top surface, bottom surface, or any other surface of the garment 10 in other arrangements.

The pocket 16 is located on the front surface 14 and is shown in a first configuration 52 in which a releasable portion 20 of the pocket 16 is attached to the front surface 14. In the first configuration 52, the front surface 14 and the pocket 16 define a second pocket 22. The second pocket 22 has a void 38 that is accessible from outside the second pocket 22 by a pair of second pocket access openings 24 located on opposite side ends of the second pocket 22. A user 42 may place his or her hand(s) 64 through one or both of the second pocket access openings 24 and into the void 38 in order to keep his or her hand(s) 64 warm or dry during bad weather. The void 38 extends all the way between the second pocket access openings 24 such that a single opening extends completely through the second pocket 22. FIGS. 1 and 2 further depict the access openings of the first and second pockets being in alignment when in the first configuration. Although described as being made of the pocket 16 and the front surface 14, the second pocket 22 may be made of different components alternatively to, or in addition to the pocket 16 and/or front surface 14 in accordance with other exemplary embodiments.

The pocket 16 includes a first member 32 and a second member 34. The members 32 and 34 may include material that is the same material as that making up the front surface 14, or other portions of the garment 10. The first member 32 and second member 34 may be made of a somewhat flexible material that allows them to be manipulated somewhat to assume various shapes. The first and second members 32 and 34 may be attached to one another to make up the pocket 16, or a single unitary member may be used to make up the pocket 16 such that two discrete portions are not attached to one another. In this arrangement, a portion of the unitary member may be referred to as the first member 32, and another portion of the unitary member may be referred to as the second member 34. A void 36 is defined between the first member 32 and the second member 34. The void 36 may be smaller than void 38 when the pocket 16 is in the first configuration 52. A pair of access openings 44 are located on opposite side ends 60 of the pocket 16 and allow the wearer 42 to place his or her hands 64 within the void 36. The side ends 60 extend between the lower edge 58 and the upper edge 56 of the pocket 16. Although the wearer 42 may place his or her hands 64 into the void 36 when the pocket 16 is in the first configuration 52, it may be a more common practice to use instead the void 38 of the second pocket 22 when the pocket 16 is in the first configuration 52. Four access openings 24 and 44 are presented to the wearer when the pocket 16 is in the first configuration 52.

The first member 32 has a window 40 that may be transparent enough to allow one to see through. The window 40 may be made of plastic or any other material capable of being transparent or semi-transparent. The window 40 may be a single piece of plastic, or may be made of multiple pieces of transparent material in various arrangements. The window 40 may be located in the center of the first member 32, or may be offset from the center in various exemplary embodiments. The window 40 can be attached to fabric making up the rest of the first member 32 by adhesives, sonic welding, fasteners, or sewing. The window 40 may be more transparent than other portions of the first member 32 such as fabric making up the first member 32. The window 40 can be arranged so that its position with respect to the first member 32 cannot change and so that that it is non-removably attached to the first member 32 and is not detachable from the first member 32.

When the pocket 16 is in the first configuration 52, the window 40 is hidden from view of a wearer 42 of the garment 10. In this regard, the window 40 is located between the front surface 14 and the second member 34. The wearer 42 will not be able to see the window 40 due to the fact that the second member 34 lies on top of the window 40 and because the window 40 is in turn located above the front surface 14. The window 40 may be the only transparent portion of the garment 10 such that all of the other portions of the garment 10 are opaque. The front surface 14 and pocket 16 may include an opaque cloth or fabric. Although the wearer 42 may in some circumstances be able to manipulate the pocket 16 so that he or she can see the window 40 through one of the second pocket access openings 24 when in the first configuration 52, this is not the normal way to use the garment 10.

The pocket 16 may be attached to the front surface 14 in two locations. A lower edge 58 of the pocket 16 may be attached to the front surface 14 so as to be permanently attached to the front surface 14. As such, the pocket 16 may include an attached portion 18 that is located at the lower edge 58 of the pocket 16 that is permanently attached to the front surface 14. The attached portion 18 is described as being permanently attached in that it is non-removably attached and is not removable during normal, intended use of the garment 10. The attached portion 18 may be attached through a sewn connection in certain exemplary embodiments. In other arrangements, the attached portion 18 may be attached through integral formation, sonic welding, or fasteners. Although described as being non-removably attached, the attached portion 18 and thus the lower edge 58 may be removably attached in accordance with other exemplary embodiments. For example, in some arrangements the lower edge 58 of the pocket 16 may be releasably attached to the front surface 14 by way of a hook and loop type fastener. Further, although described as being located at the lower edge 58, the attached portion 18 may be at a location other than the lower edge 58 of the pocket 16 in other exemplary embodiments. The attached portion 18 may extend along the entire length of the lower edge 58 in some arrangements. The attached portion 18 may function to cause the front surface 14, the first member 32 and the second member 34 to be non-removably attached to one another at this location.

The second point of attachment of the pocket 16 to the front surface 14 is at the upper edge 56 of the pocket 16. The pocket 16 has a releasable portion 20 at this location that functions to cause the pocket 16 to be releasably attachable to the front surface 14 at this point. The releasable portion 20 is disclosed as being a plurality of hooks 28 that are located on the surface of the first member 32. The releasable portion 20 is not located on the second member 34, and the hooks 28 are not located on the second member 34. However, the first member 32 and the second member 34 are attached to one another at the upper edge 56 and thus cannot be separated from one another at this point.

The releasable portion 20 engages a receiving portion 46 that is located on the front surface 14. The receiving portion 46 may be non-removably attached to the front surface 14. The receiving portion 46 may be loops 30 that are complimentary to the hooks 28 such that when in contact cause the pocket 16 to be engaged to the front surface 14 at the upper edge 56 of the pocket 16. The hooks 28 and the loops 30 form a hook and loop type fastener 26 that can be used to cause the pocket 16 to be releasably attached to the front surface 14. Although the releasable portion 20 has been described as being hooks 28, and the receiving portion 46 being loops 30, the opposite arrangement can be made in other versions of the garment 10.

Further, as a releasable connection is made, the hook and loop type fastener 26 may be replaced in other embodiments.

For example, buttons, a zipper, snaps, tabs, pins, or mechanical fasteners can be used to cause the pocket 16 to be releasably attached to the front surface 14. When engaged, the hooks 28 attach to the loops 30 to prevent he pocket 16 and front surface 14 from detaching from one another at this location. The wearer 42 can wear the garment 10 and place his or her hands inside of the void 38 without the pocket 16 falling away from the front surface 14 or otherwise becoming detached from the front surface 14.

Figure 3:
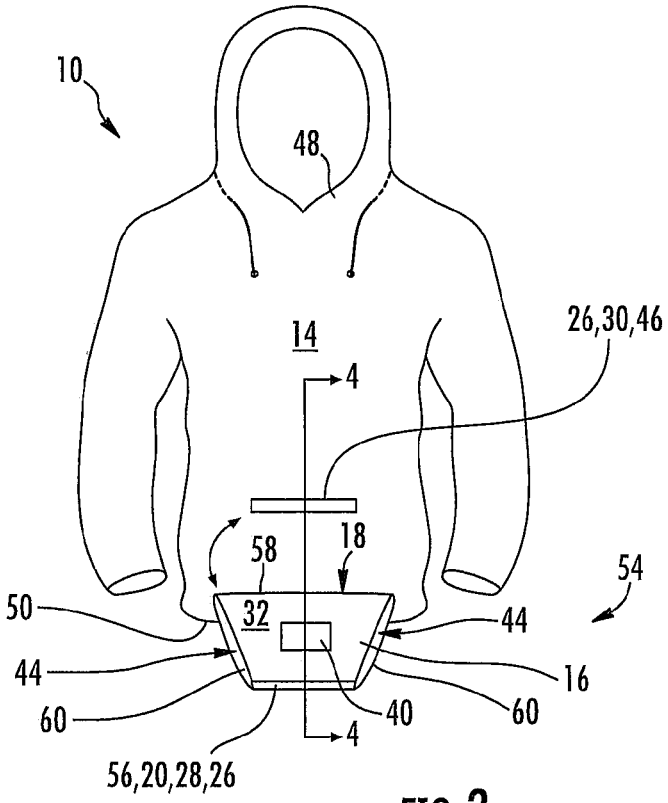
FIG. 3 is a front elevation view of the garment of FIG. 1 with the detachable pocket detached from the front surface of the garment.
Figure 4:
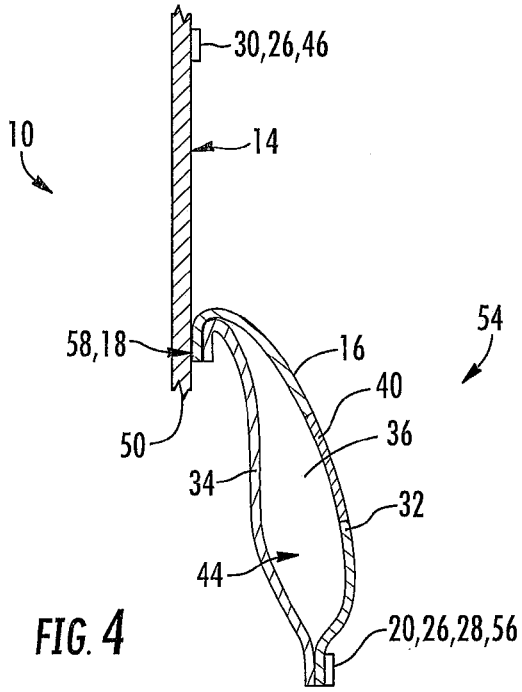
FIG. 4 is a cross-sectional view taken along line 4-4 of FIG. 3 with a portion of the garment not shown for clarity.

The arrangement of the pocket 16 in the first configuration 52 may be made when the wearer 42 does not need to view the electronic device 12. Upon desiring to use the electronic device 12, the wearer 42 may reconfigure the pocket 16 into the second configuration 54 shown with reference to FIGS. 3 and 4. The wearer 42 may grasp the pocket 16 and pull it away from the front surface 14 in order to detach the releasable portion 20 from the receiving portion 46. The hook and loop fastener 26 is arranged to hold together until a threshold amount of pulling force is applied in order to separate the hooks 28 from the loops 30 that causes the pocket 16 to be released from the front surface 14 at the upper edge 56. Releasing the pocket 16 causes the pocket 16 to fall downwards and away from the front surface 14. The pocket 16 may fall below a bottom edge 50 of the garment 10/front surface 14 such that the majority of the pocket 16 is located at a height in the vertical direction below the bottom edge 50. The pocket 16 is retained onto the front surface 14 because the attached portion 18 remains attached to the front surface 14. The attached portion 18 may be the portion of the pocket 16 that is highest in the vertical direction when the pocket 16 is in the second configuration 54 and when the wearer 42 is standing.

When the pocket 16 is reconfigured into the second configuration 54, the second pocket 22 is no longer present. This is because the upper edge 56 is removed from the front surface 14. In the second configuration 54, the pocket 16 is still present, and the window 40 of the first member 32 is exposed for view by the wearer 42 as the window 40 is located generally on the upper surface of the pocket 16. The access openings 44 are likewise still present in the second configuration 54 to afford access into the void 36 of the pocket 16. The second member 34 is generally concealed from view from the wearer 42 when the wearer 42 is in a standing position and when the pocket 16 is in the second configuration 54. The receiving portion 46 remains attached to the front surface 14 in the second configuration 54 and as shown may be a rectangular shaped strip that runs laterally along the front surface 14. When the wearer 42 desires to reconfigure the pocket 16 back to the first configuration, he or she simply pivots the pocket 16 about the attached portion 18 and reapplies the hook and loop fastener 26 such that the hooks 28 of the releasable portion 20 engage and attach to the loops 30 of the receiving portion 46. The material making up the first and second members 32, 34 at the attached portion 18 may be fabric or other flexible material that allows the first and second members 32, 34 to bend, flex so as to hinge about the attached portion 18. The attached portion 18 is located some distance from the bottom edge 50 of the front surface/garment 10 and is thus not located at the bottom edge 50. However, in other embodiments the attached portion 18 may in fact be located at the bottom edge 50.

In the second configuration 54, the lower edge 58 may be closer to the neck 48 of the garment 10 than the upper edge 56 of the pocket 16. However, due to the flexible nature of the pocket 16, the user could reposition the pocket 16 so as to pivot same about the attached portion 18 such that the upper edge 56 is closer to the neck 48 than the lower edge 58, or so that the edges 56 and 58 are the same distance to the neck 48 in the vertical, height direction when the wearer 42 is wearing the garment 10.

Figure 5:
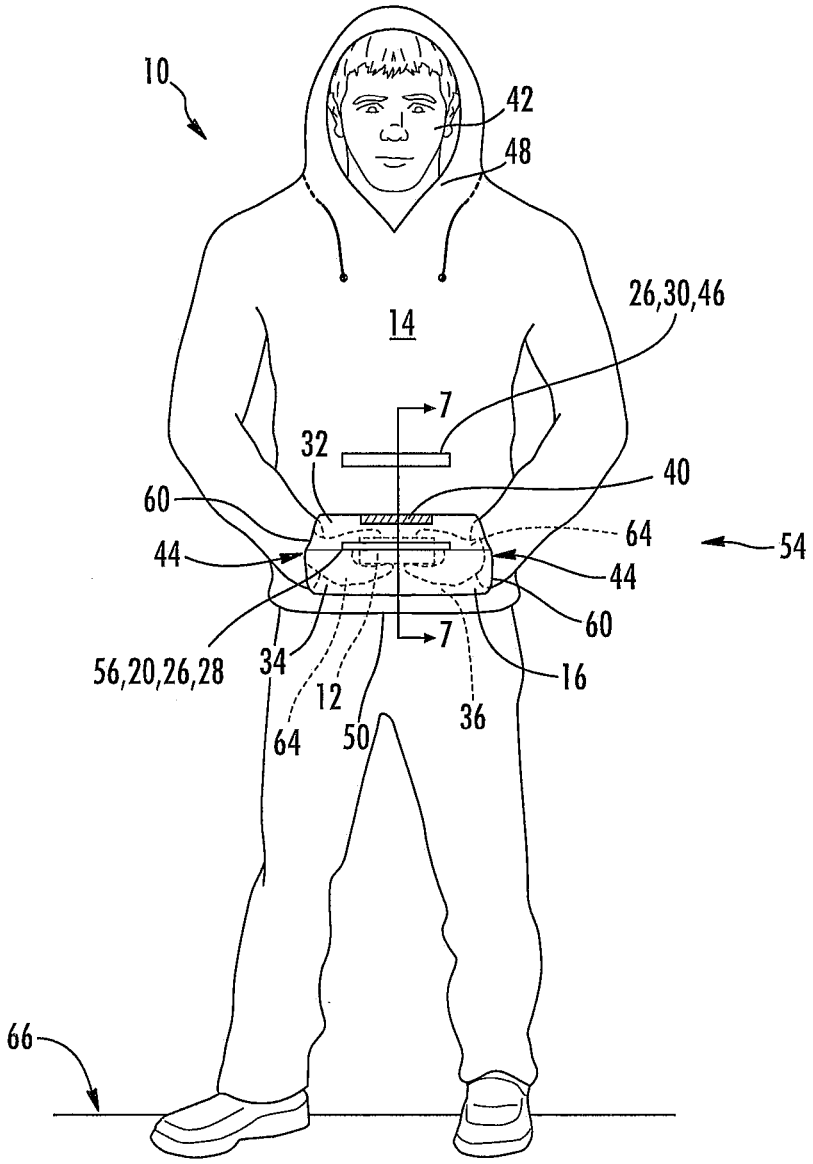
FIG. 5 is a front elevation view of the garment of FIG. 1 being worn by a user with hands and an electronic device within the pocket that is detached from the garment.
Figure 6:
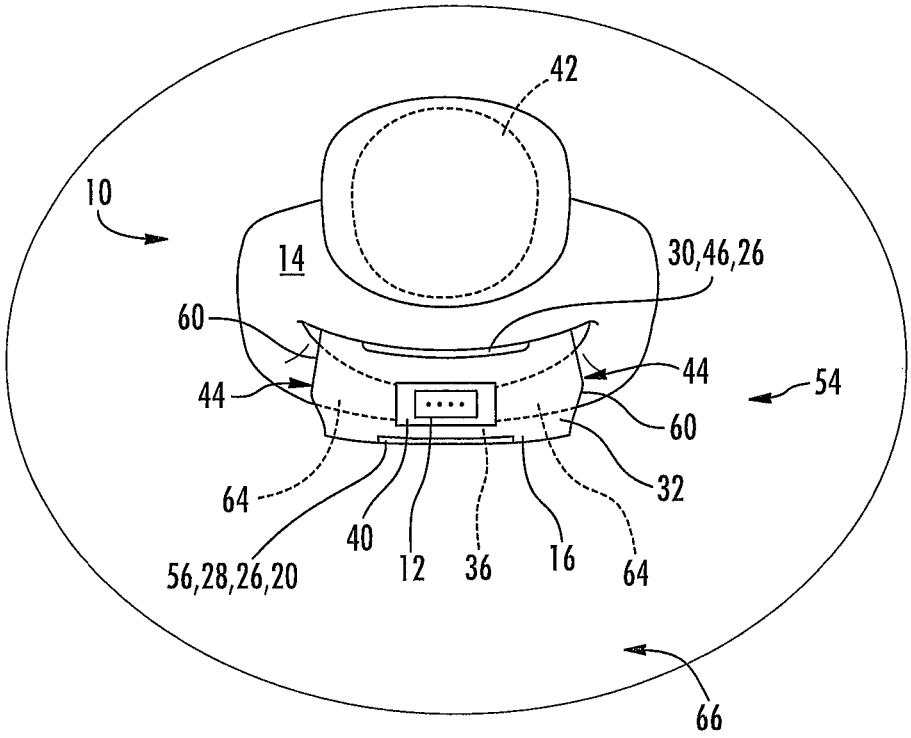
FIG. 6 is a top plan view of the worn garment of FIG. 5.
Figure 7:
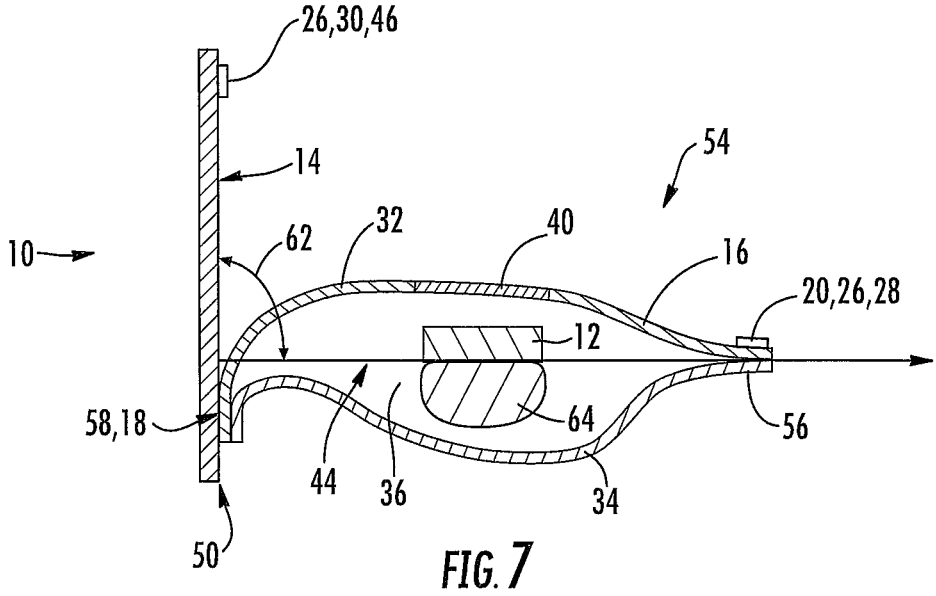
FIG. 7 is a cross-sectional view taken along line 7-7 of FIG. 5 with a portion of the garment not shown for clarity.

FIGS. 5-7 show the pocket 16 in the second configuration 54 and show a wearer 42 wearing the garment 10 and standing in a vertical orientation. In the orientation shown, the feet of the wearer 42 are located on the ground 66 and the neck 48 is higher than the pocket 16 in the vertical direction such that the pocket 16 is located between the ground 66 and the neck 48 of the garment 10 in the vertical direction. The wearer 42 may reconfigure the pocket 16 from the first configuration 52 to the second configuration 54 when the wearer 42 desires to view the electronic device 12 while at the same time keeping his or her hands 64 warm and dry within the pocket 16. The access openings 44 of the pocket 16 are present when the pocket 16 is in the second configuration 54 and the user 42 may place his or her left hand 64 through one of the access openings 44, and may place his or her right hand 64 through the other one of the access openings 44. The hands 64 can be placed inside of the void 36 and can be protected by the members 32, 34 of the pocket 16 from the elements.

In order to more comfortably make use of the pocket 16, the user 42 may pivot the pocket 16 at the attached portion 18 so that the upper edge 56 of the pocket 16 is located at an angle 62 of ninety degrees to the front surface 14. The angle 62 need not be ninety degrees in other embodiments, and may be selected to meet the comforts of the user 42. For example, the angle 62 may be from 45°-80°, from 80°-100°, from 100°-130°, or up to 180° in various exemplary embodiments. The placement of the pocket 16 at an angle 62 of ninety degrees allows the window 40 to be exposed to view of the wearer 42 when the wearer 42 is in a standing, sitting, or reclined position.

The wearer 42 may hold the electronic device 12 within the void 36 of the pocket 16 such that both of his or her hands 64 are also located within the void 36. The wearer 42 may view the electronic device 12 through the window 40 and thus use the electronic device 12 in the normal course. Both the electronic device 12 and the user's hands 64 are kept warm and dry from the elements due to their positioning within the pocket 16 and because the window 40 may prevent water from flowing therethrough. The fabric of the pocket 16 may be waterproof in some arrangements, and may not be waterproof in other arrangements. Although not waterproof, the fabric of the first and second members 32, 34 may still be sufficiently protective to keep some or all water away or off of the electronic device 12 during use.

The ability to position the pocket 16 so that the window 40 faces the wearer 42 or others, for example people in proximity to the wearer 42, provides additional utility to the garment 10. The hinging of the pocket 16 about the lower edge 58 allows the window 40 to be placed at a desired position for viewing without causing the front surface 14 to be pulled or twisted from its normal position during wear of the garment 10. As such, the front surface 14 may not be pulled away from the body of the wearer 42 or twisted or otherwise deformed when changing the positioning of the window 40 to achieve a desired location for viewing as the pivoting at the attached portion 18 allows the pocket 16 to be pivoted with respect to the front surface 14.

Once the wearer 42 is done using the electronic device 12 in the pocket 16, he or she may remove their hands 64 from pocket 16 and reconfigure pocket 16 into the first configuration 52. The user 42 can place their hands 64 into the second pocket 22 present in the first configuration 52 but cannot view the electronic device 12 since the window 40 is obscured. The first configuration 52 affords a cosmetic appearance of the pocket 16 in which the window 40, and any separate covering associated with the window 40, is not visible. As such, a flap or component that functions to cover the window 40, that can be removed or opened when viewing through the window 40 is desired, that is smaller than the first member 32 onto which the window 40 is carried is not present in the garment 10.

Although the pocket 16 has been described as having the lower edge 58 non-removably attached at the attached portion 18, and the upper edge 56 removably attached at the receiving portion 46, the pocket 16 can be made in an opposite configuration. Here, the pocket 16 can flip "upwards" upon being reconfigured from the first configuration 52 to the second configuration 54. Yet alternatively, both the lower edge 58 and the upper edge 56 could be releasably attachable through hook and loop type fasteners so the wearer 42 has the option of deciding which one to detach when utilizing the pocket 16. The window 40 may be in the second member 34 instead of the first member 32, and in other arrangements windows 40 may be in both of the members 32 and 34. In some arrangements, the window 40 may make up all or substantially all of the first member 32 such that no or very little fabric is present in the first member 32.

The electronic device 12 that is used in conjunction with the garment 10 may be a cell phone, a smart phone, a watch, a PDA, an electronic game, a pager, a calculator, a puzzle solver, a miniature computer, or any other electronic device that can be held by the hand 64 or worn on the wrist or hand 64 and otherwise actuated by the hand 64. The pocket 16 can be modified in other arrangements so that it does not accommodate both hands 64 of the user but instead is able to only accommodate a single hand 64. Further, a wall or other separation may exist within the pocket 16 so that the hands 64 of the user 42 cannot directly touch one another.

Figure 8:
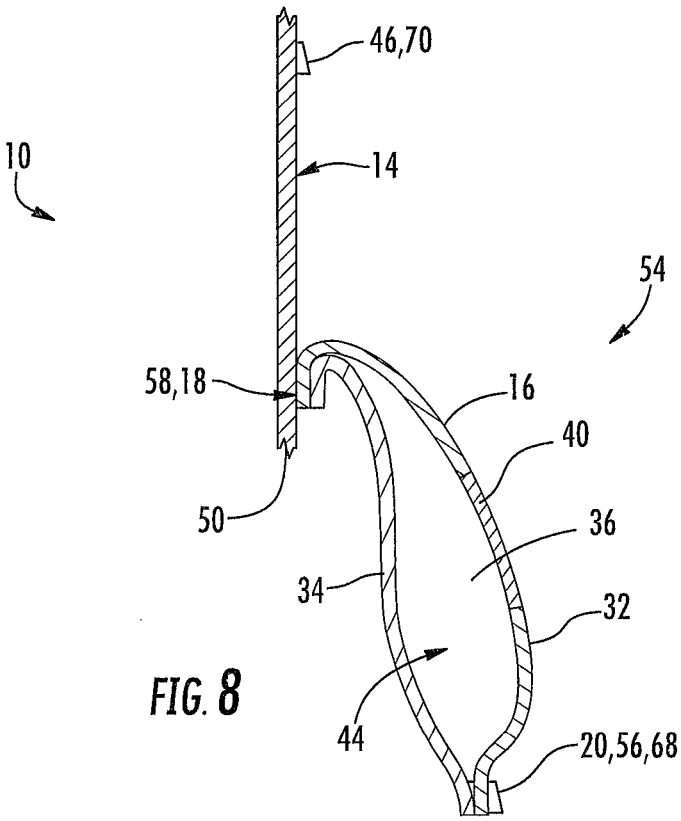
FIG. 8 is a cross-sectional view of an alternative exemplary embodiment where the releasable portion includes a magnet.

An alternative exemplary embodiment of the garment 10 is illustrated with reference to FIG. 8 which is a cross-sectional view of the pocket 16 in the second configuration 54. The releasable portion 20 includes a magnet 68, and the hook and loop fastener 26 that includes the hooks 28 and loops 30 are is not present. The magnet 68 may be permanently attached to the upper edge 56 of the pocket 16. The magnet 68 may be attracted to an attractive portion 70, for example a material attracted to a magnet such as iron, nickel or steel, and when in close proximity releasably attach to one another. The attractive portion 70 can be permanently attached to the front surface 14 through adhesion, mechanical fasteners, or the like. Engagement and attraction between the magnet 68 and the attractive portion 70 causes the pocket 16 to be arranged into the first configuration 52 as shown, for example, in FIG. 1. The remaining portions of the garment 10 and pocket 16 can be configured as previously discussed and a repeat of this information is not necessary.

The attractive portion 70 could alternatively be permanently attached to the upper edge 56 of the pocket 16, and the magnet 68 could be permanently attached to the front surface 14 of the garment 10. The attractive portion 70 could be a magnet in certain embodiments, and thus both the attractive portion 70 and the magnet 68 could be magnets that are attracted to one another in certain arrangements. The force of attraction between the magnet 68 and the attractive portion 70 may be selected so that the pocket 16 is retained in the first configuration 52 and is not detachable into the second configuration 54 until a sufficient amount of force is applied by the user. The magnet 68 and the attractive portion 70 may each be single piece or may be multiple pieces along the length of the upper edge 56.

Figure 9:
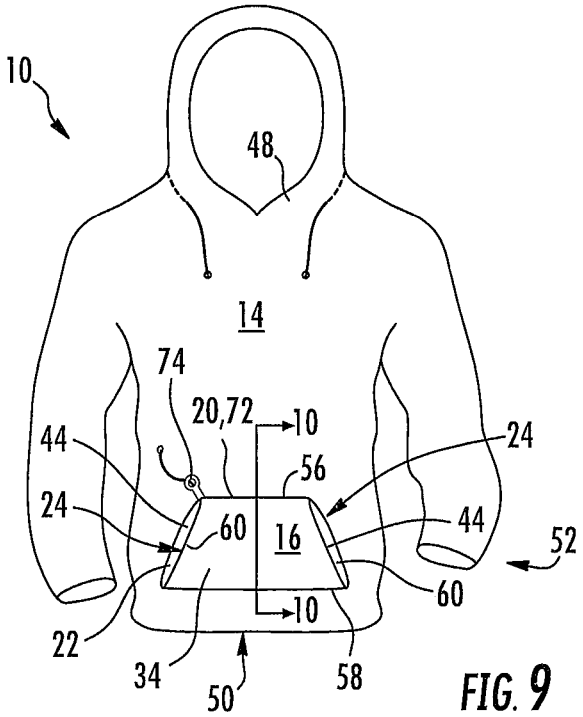
FIG. 9 is a front view of an alternative exemplary embodiment where the releasable portion includes a zipper.
Figure 10:
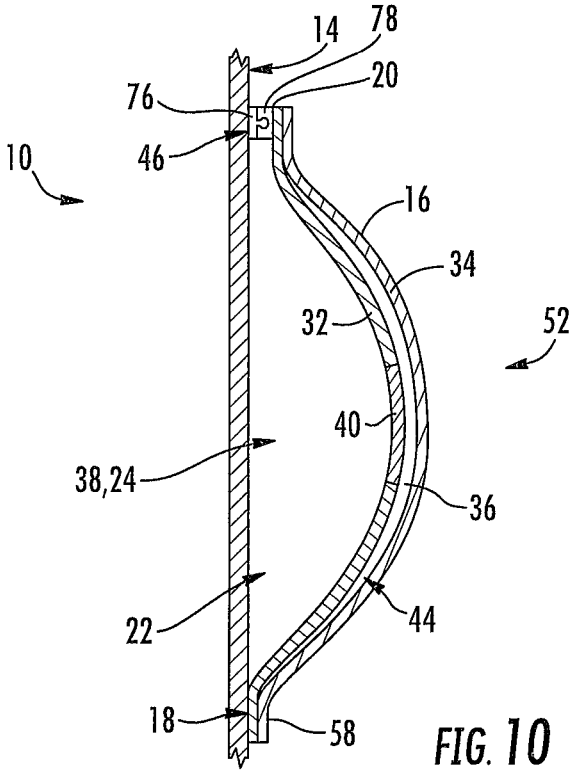
FIG. 10 is a cross-sectional view taken along line 10-10 of FIG. 9.

A yet further exemplary embodiment of the garment 10 is illustrated with reference to FIGS. 9 and 10. The garment 10 can be configured in the same manner previously described with reference to the embodiments in FIGS. 1-7 and a repeat of this information is not necessary. However, instead of the hook and loop fastener 26, a zipper 72 is employed to effect releasable attachment of the pocket 16 to the front surface 14. The pocket 16 is shown in the first configuration 52 in FIG. 9, and the zipper 72 is in the closed state in which the pocket 16 is attached to the front surface 14. The zipper 72 includes a slider 74 that can be grasped by a user and pulled. The slider 74 may be slid along the length of the releasable portion 16 until the end at which the zipper 72 is moved into the open state.

The zipper 72 includes a series of first clasps 76 and a series of second clasps 78 that engage one another when the zipper 72 is in the closed state to effect attachment of the pocket 16 to the front surface 14 in the first configuration 52. The first clasps 76 may be permanently attached to the front surface 14, and the second clasps 78 may be permanently attached to the upper edge 56 of the pocket 16. The first clasps 76 and second clasps 78 interdigitate with one another when the zipper 72 is closed to effect attachment of the releasable portion 20. The slider 74 can be actuated in order to disengage the first clasps 76 from the second clasps 78 to disengage the pocket 18 from the front surface 14. The slider 74 can be subsequently positioned to again interlock the clasps 76 and 78 and moved to cause the clasps 76 and 78 to engage one another to place the pocket 16 into the first configuration 52. In this manner, the pocket 16 is configured for releasable attachment with the front surface 14 via the zipper 72.

The zipper 72 can be included on both the releasable portion 20 and the receiving portion 46. In this regard the first clasps 76 may be on the receiving portion 46, and the second clasps 78 and slider 74 of the zipper 72 may be on the releasable portion 20. The zipper 72 may thus include components permanently attached to both portions 20 and 46.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A garment, comprising:

a front surface;

a pocket secured to said front surface and selectively positionable between a first attached configuration and a second unattached configuration, said pocket having (i) a first surface and a second surface, said first surface comprising a window permitting visualization of at least a portion of the interior of said pocket;

(ii) a plurality of access openings on opposite ends of said pocket; and (iii) at least one releasable portion permitting movement of said pocket between said first configuration and said second configuration; and a second pocket between said front surface and said pocket in said first configuration, having a pair of second pocket access openings on opposite ends thereof.

2. The garment as set forth in claim 1, wherein said pocket comprises an attached portion secured to said front surface and forming a pivot point for movement of said pocket between said first configuration and said second configuration.

3. The garment as set forth in claim 1, wherein the garment is selected from the group consisting of a hoodie, a jacket, a sweatshirt, and a shirt.

4. The garment as set forth in claim 1, wherein said window is hidden from view in said first configuration and is exposed for view in said second configuration.

5. The garment as set forth in claim 1, wherein said window is made of plastic.

6. The garment as set forth in claim 1, wherein said front surface comprises a receiving portion releasably engaging said at least one releasable portion of said pocket to define said first configuration and said at least one releasable portion selectively detached therefrom to define said second configuration.

7. The garment as set forth in claim 6, wherein one of said receiving portion and said at least one releasable portion has a magnet, wherein the other one of said receiving portion and said at least one releasable portion has a corresponding attractive portion.

8. The garment as set forth in claim 6, wherein at least a portion of said receiving portion and said at least one releasable portion each comprise corresponding clasps of a zipper.

9. The garment as set forth in claim 2, wherein said window faces said front surface and is concealed from view in said first configuration and is angled from said garment surface and exposed for view in said second configuration.

10. The garment as set forth in claim 9, wherein said pocket is oriented at an angle of up to 180 degrees to said front surface in said second configuration.

11. A garment, comprising:

a front surface; and a first pocket defined between a first member and a second member and having a pair of access openings on opposite side ends, said first pocket having an attached portion secured to said front surface and at least one releasable portion releasably attached to said front surface, said first pocket selectively positionable between a first configuration defined by said at least one releasable portion releasably attached to said front surface and a second configuration;

a second pocket defined between said first member and said front surface in said first configuration and having a pair of second access openings on opposite side ends; and said first member having a window permitting visualization into at least a portion of said first pocket in said second configuration, said window facing said front surface and said second member covering said window in said first configuration.

12. The garment as set forth in claim 11, wherein said front surface and said at least one releasable portion include at least one of hook and loop type fasteners, zippers, and magnets to releasably attach said at least one releasable portion and said front surface.

13. The garment as set forth in claim 11, wherein the garment is a hoodie and wherein said window is made of plastic.

14. The garment as set forth in claim 1, wherein said at least one releasable portion releasably engages said front surface in said first configuration and is detached from said front surface in said second configuration.

15. The garment as set forth in claim 1, wherein each of said access openings of said pocket and said second pocket are accessible in said first configuration.

16. The garment as set forth in claim 1, wherein said access openings of said pocket and said second pocket are aligned in said first configuration.

17. The garment as set forth in claim 6, wherein said receiving portion and said at least one releasable portion comprise corresponding hook and loop fasteners.

18. The garment as set forth in claim 11, wherein said attached portion of said first pocket permits pivoting movement of said first pocket between said first configuration and said second configuration.

19. The garment as set forth in claim 18, wherein said first pocket pivots up to 180 degrees from said front surface in said second configuration.

20. The garment as set forth in claim 11, wherein said at least one releasable portion of said first pocket releasably engages said front surface in said first configuration and is selectively detached from said front surface in said second configuration.

21. The garment as set forth in claim 11 wherein each of said access openings of said first and second pockets are accessible in said first configuration.

22. The garment as set forth in claim 11, wherein said access openings of said first and second pockets are aligned in said first configuration.

* * * * *